US011466598B2

(12) United States Patent
Ricco et al.

(10) Patent No.: US 11,466,598 B2
(45) Date of Patent: Oct. 11, 2022

(54) SYSTEM AND METHOD FOR VARIABLE ACTUATION OF VALVES OF AN INTERNAL COMBUSTION ENGINE

(71) Applicant: C.R.F. SOCIETA CONSORTILE PER AZIONI, Orbassano (IT)

(72) Inventors: Raffaele Ricco, Orbassano (IT); Sergio Stucchi, Orbassano (IT); Marcello Gargano, Orbassano (IT); Domenico Lepore, Orbassano (IT); Chiara Altamura, Orbassano (IT)

(73) Assignee: C.R.F. SOCIETÀ CONSORTILE PER AZIONI, Orbassano (IT)

( * ) Notice: Subject to any disclaimer, the term of this patent is extended or adjusted under 35 U.S.C. 154(b) by 66 days.

(21) Appl. No.: 17/108,188

(22) Filed: Dec. 1, 2020

(65) Prior Publication Data

US 2021/0164368 A1 Jun. 3, 2021

(30) Foreign Application Priority Data

Dec. 2, 2019 (EP) ..... 19212927

(51) Int. Cl.

| | |
|---|---|
| ***F01L 9/20*** | (2021.01) |
| ***F01L 1/047*** | (2006.01) |
| ***F01L 1/14*** | (2006.01) |
| ***F01L 1/46*** | (2006.01) |
| ***F02B 23/10*** | (2006.01) |
| ***F02D 13/02*** | (2006.01) |

(52) U.S. Cl.

CPC ..... *F01L 9/20* (2021.01); *F01L 1/047* (2013.01); *F01L 1/14* (2013.01); *F01L 1/462* (2013.01); *F02B 23/10* (2013.01); *F02D 13/0226* (2013.01); *F02B 2023/106* (2013.01)

(58) Field of Classification Search

CPC ... F02B 23/10; F01L 1/462; F01L 1/14; F01L 1/047; F01L 9/20

See application file for complete search history.

(56) References Cited

U.S. PATENT DOCUMENTS 4,615,306 A * 10/1986 Wakeman ..... F01L 13/0021 123/90.46
8,079,331 B2 * 12/2011 Vattaneo ..... F01L 9/14 123/90.12

FOREIGN PATENT DOCUMENTS

| | | |
|---|---|---|
| EP | 0803642 B1 | 10/1997 |
| EP | 1508676 B1 | 2/2005 |
| EP | 1555398 A1 | 7/2005 |

(Continued)

OTHER PUBLICATIONS

European Search Report dated May 25, 2020.

*Primary Examiner* — Kevin A Lathers

(74) *Attorney, Agent, or Firm* — Heslin Rothenberg Farley & Mesiti P.C.; Victor A. Cardona, Esq.

(57) ABSTRACT

In an internal combustion engine provided with an electro-hydraulic system for variable actuation of the intake valves of the engine, each cylinder has two intake valves, which are associated with two intake conduits and are controlled by a single cam of a camshaft through a single hydraulic circuit. The communication of the hydraulic actuators of the two intake valves with a discharge channel is controlled by two electrically-actuated control valves, both of an on/off two-position type, arranged in series with each other along a hydraulic line for communication between the a pressure volume and the discharge channel.

19 Claims, 7 Drawing Sheets

(56) References Cited

FOREIGN PATENT DOCUMENTS

Figure 1:
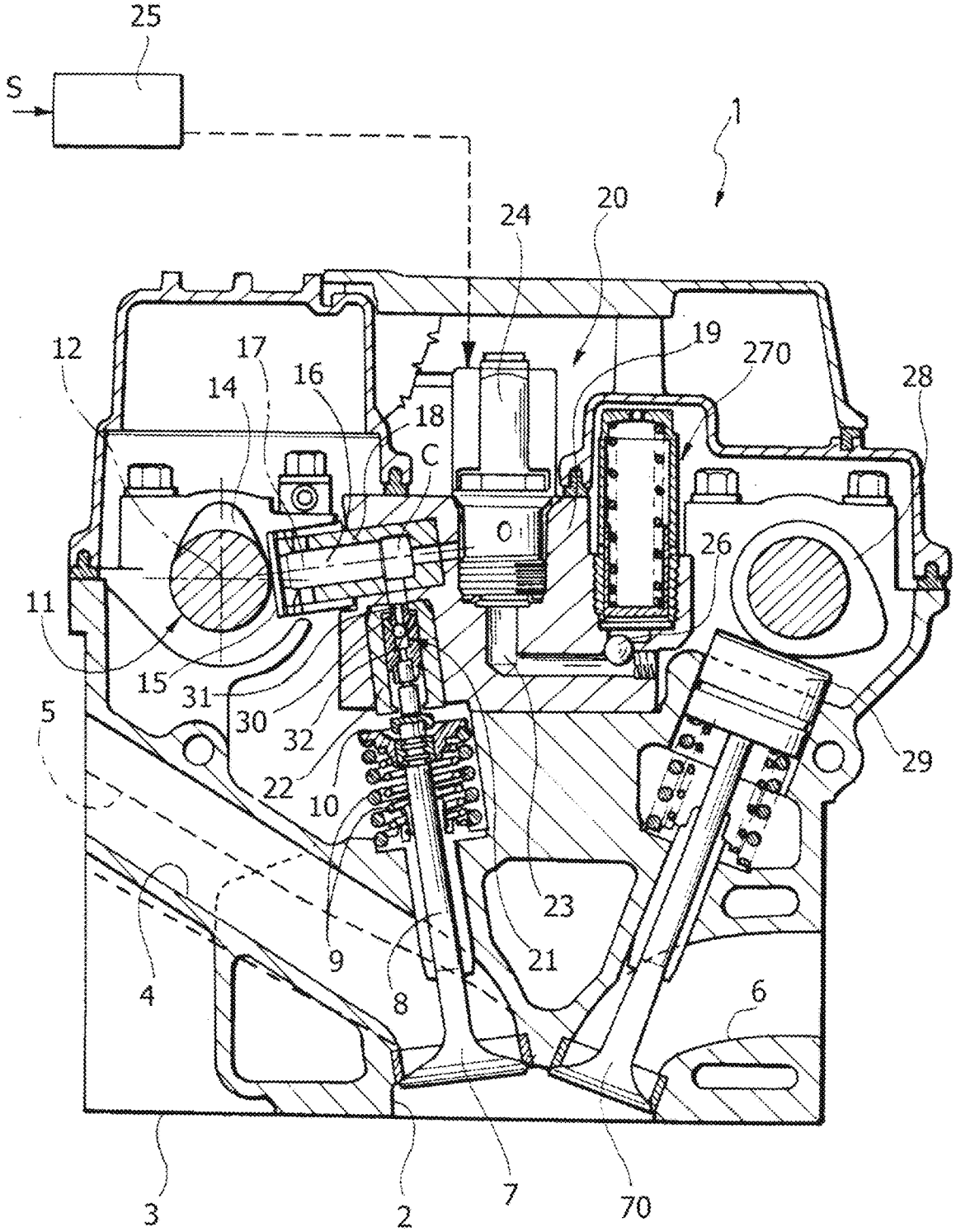

| | | | |
|---|---|---|---|
| EP | 1674673 | A1 | 6/2006 |
| EP | 1674673 | B1 | 6/2006 |
| EP | 1726790 | A1 | 11/2006 |
| EP | 2261471 | A1 | 12/2010 |
| EP | 2693007 | A1 | 5/2014 |
| EP | 2801706 | A1 | 12/2014 |
| GB | 2562269 | A | 11/2018 |
| JP | 2003013742 | A | 1/2015 |

* cited by examiner

--PRIOR ART--

--PRIOR ART--

FIG. 3 --PRIOR ART--
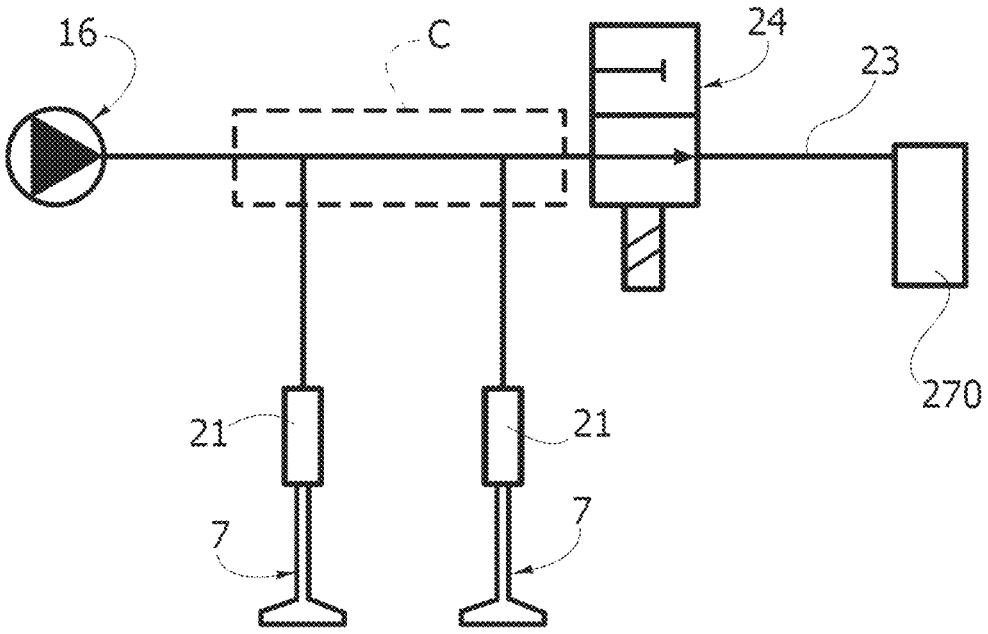
--PRIOR ART--
FIG. 4
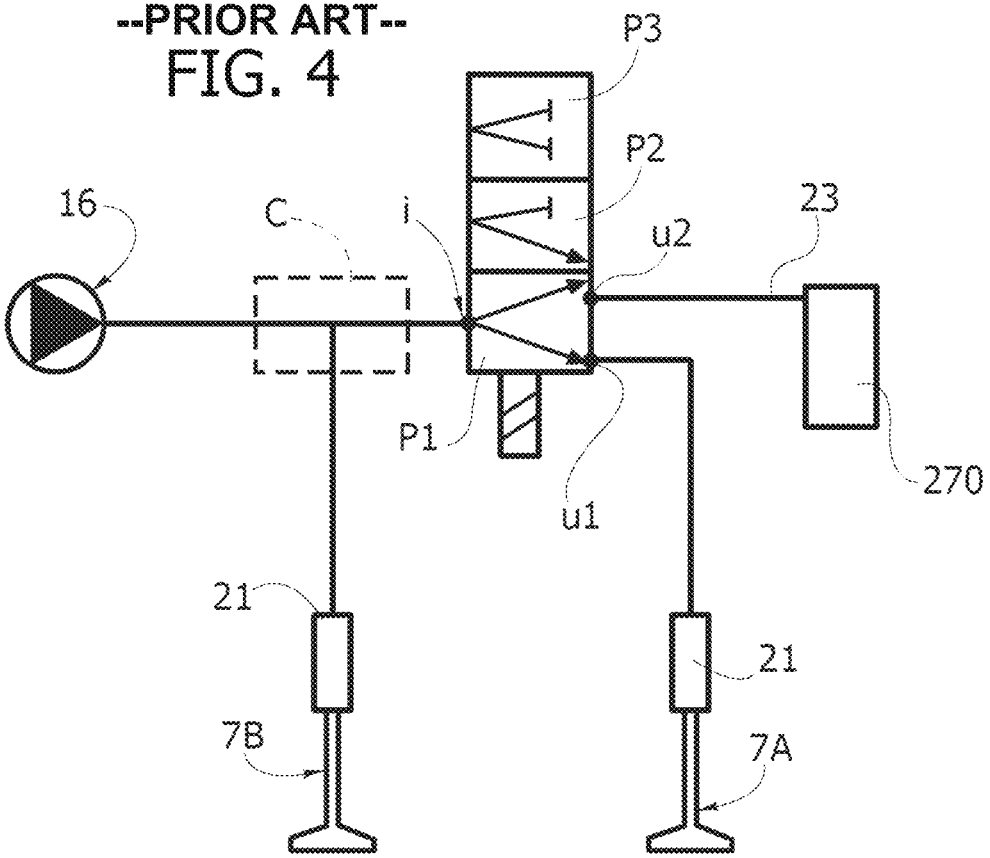

FIG. 5 --PRIOR ART--
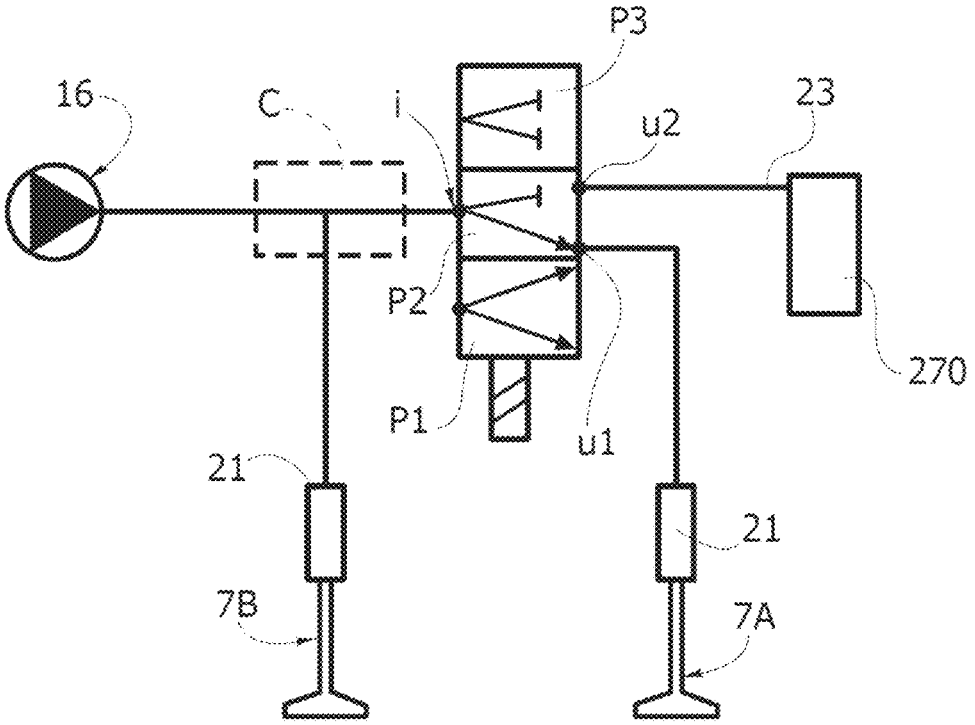
FIG. 6 --PRIOR ART--
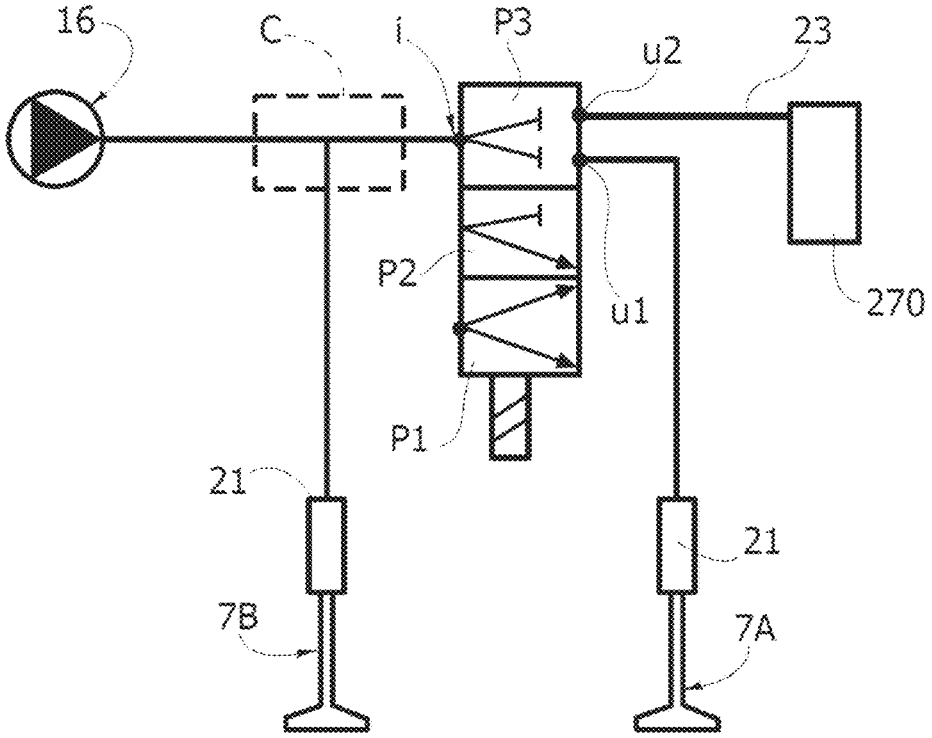

--PRIOR ART--

--PRIOR ART--

--PRIOR ART--

SYSTEM AND METHOD FOR VARIABLE ACTUATION OF VALVES OF AN INTERNAL COMBUSTION ENGINE

CROSS REFERENCE TO RELATED APPLICATIONS

This application claims priority to European Patent Application No. 19212927.8 filed on Dec. 2, 2019, the entire disclosure of which is incorporated herein by reference.

FIELD OF THE INVENTION

The present invention relates to systems and methods for variable actuation of valves of an internal combustion engine.

PRIOR ART

Since a long time, the Applicant has been developing internal combustion engines comprising a system for variable actuation of the intake valves, which is marketed under the trademark "Multiair", having a high degree of operational flexibility. See for example EP 0 803 642 B1, EP 1 555 398, EP 1 508 676 B1, EP 1 674 673 B1 and EP 2 261 471 A1, EP 2 693 007 A1, EP 2 801 706 A1, all in the name of the same Applicant.

According to this known art developed by the Applicant (see for example EP 2 801 706 A1) an internal combustion engine is provided, comprising, for each cylinder:

- a combustion chamber,
- first and second intake conduits and at least one exhaust conduit opening on said combustion chamber,
- first and second intake valves associated to said first and second intake conduits respectively and at least one exhaust valve associated to said at least one exhaust conduit, said intake and exhaust valves being provided with respective return springs which bias them towards a closed position,
- a camshaft for actuating the intake valves, by means of respective tappets,
- wherein each intake valve is driven by a respective tappet against the action of said return spring with the interposition of a hydraulic circuit including a volume of a fluid under pressure towards which a pumping piston associated to the valve tappet is facing, said volume of fluid under pressure being adapted to communicate with a chamber of a hydraulic actuator associated to said intake valve,
- each intake valve being associated to at least one electrically operated control valve adapted to communicate said volume of fluid under pressure with a low pressure discharge channel (a discharge channel), in order to uncouple said intake valve from the respective tappet and cause a quick closing of said intake valve due to the bias of the respective return spring,
- at least one electronic controller, for controlling said at least one control valve, for varying the opening and/or closing time and the lift of each intake valve as a function of one or more operational parameters of the engine.

The present invention is directed to a new embodiment of the above described "Multiair" technology.

OBJECT OF THE INVENTION

A first object of the present invention is that of providing a system and a method for variable actuation of the intake valves of an internal combustion engine which is relatively simple and reduced in cost, while providing at the same time a high operational flexibility.

A second object of the invention is to provide a system and a method for actuating the intake valves of an internal combustion engine that enables the intake valves associated with the same cylinder of the engine to be controlled in a differentiated manner, while providing a single cam and a single hydraulic circuit for actuating the intake valves of a same cylinder of the engine.

SUMMARY OF THE INVENTION

The invention provides an internal combustion engine having all the features of the above indicated Multiair technology (and defined in the preamble of the annexed claim 1) and further characterized in that the two intake valves of each cylinder are controlled by a single cam of said camshaft through a single hydraulic circuit and a communication of the hydraulic actuators of the two intake valves with said discharge channel is controlled by means of two electrically operated control valves, both of an on/off and two-position type, which are arranged in series relative to each other along a hydraulic line for communication between the volume of fluid under pressure and the discharge channel. Said communication hydraulic line includes, starting from said volume of fluid under pressure towards said discharge channel:

- a first branch-off point connected to the hydraulic actuator of a first intake valve,
- a second branch-off point connected to the hydraulic actuator of a second intake valve.

A first of said control valves is arranged between said second branch-off point and the discharge channel, so that when said first control valve is closed, the communication with the discharge channel is interrupted for both the hydraulic actuators of the intake valves.

A second control valve is arranged in said communication line between the two above mentioned branch-off points, so that when said second control valve is closed:

- the actuator of the first intake valve is always in communication with the volume of fluid under pressure, whereas its communication with the discharge channel is anyway interrupted, independently from the condition of operation of the first control valve,
- the actuator of the second intake valve does no longer communicates with the volume of fluid under pressure, independently from the conditional operation of the first control valve.

Due to the above indicated features, the engine according to the invention is able to operate with differentiated actuating modes of the two intake valves associated with a same cylinder; at the same time, the electro-hydraulic system which is used for controlling the operation of the intake valves is extremely simple, of reduced cost and implies also a simplified programming.

The invention is also directed to the method for controlling the engine according to the above described modes.

In a preferred embodiment said electronic controller is configured and programmed to control said control valves in such a way as to partially or totally open only the first intake valve of each cylinder in a reduced operating condition of the engine, below a predetermined load of the engine and/or below a predetermined speed of revolution of the engine, and in such a way as to partially or totally open both intake valves in the remaining operating conditions of the engine.

In one example, said first intake duct is configured in such a way as to generate within the cylinder a tumble motion of the air flow introduced into the cylinder through said first intake conduit (i.e. a vortex around an axis orthogonal to the axis of the cylinder) when the first intake valve associated therewith is at least partially opened, and said second intake conduit is configured in such a way as to generate within the cylinder a swirl motion of the air flow introduced into the cylinder through said second intake duct (i.e. a spiral motion around the axis of the cylinder) when the second intake valve associated therewith is at least partially opened. However, this configuration is only a possible example of application of the variable actuation system of the intake valves with which the engine according to the invention is provided.

In this example, the intake valve which is the only one to be opened, partially or totally, in the aforementioned reduced operating condition of the engine is said first intake valve, associated with the aforementioned first intake conduit, which is configured to generate a motion by tumble.

In the above preferred embodiment the electronic controller is configured and programmed to control said control valves so that, at least in one intermediate conditional operation of the engine, above said condition of reduced operation, said second intake valve is controlled according to a partial lift mode, in which it has a lift movement smaller with respect to its maximum lift.

In said partial lift mode, the second intake valve can be controlled in various manners. For example, the second intake valve can remain in a fixed position, corresponding to a predetermined partial lift, during its opening cycle.

Alternatively, the second intake valve can be controlled according to a late opening mode, in which it is opened with a delay with respect to the starting time of the lift cycle caused by the profile of the respective actuating cam.

In this case, said second intake valve is again closed together with the first intake valve, at the end of the lift cycle determined by the profile of the respective actuating cam.

According to a further mode, said second intake valve can be controlled according to a multi-lift mode, in which it is partially opened and then closed again completely, many times during a same lift cycle.

Finally, according to a further example, said second intake valve can be controlled according to a delayed closing mode, in which it is opened partially together with the first intake valve and then closed completely with a delay with respect to the end of a lift cycle of the respective actuating cam.

Preferably, in stages in which only said first intake valve is opened, when the pressurized fluid displaced by said pumping piston is transferred only to the actuator of said first intake valve, said first intake valve is prevented from having a lift higher than a predetermined maximum limit, putting said actuator in communication with a discharge line when a predetermined stroke of the first intake valve is exceeded.

DESCRIPTION OF SOME EMBODIMENTS OF THE INVENTION

Figure 2:
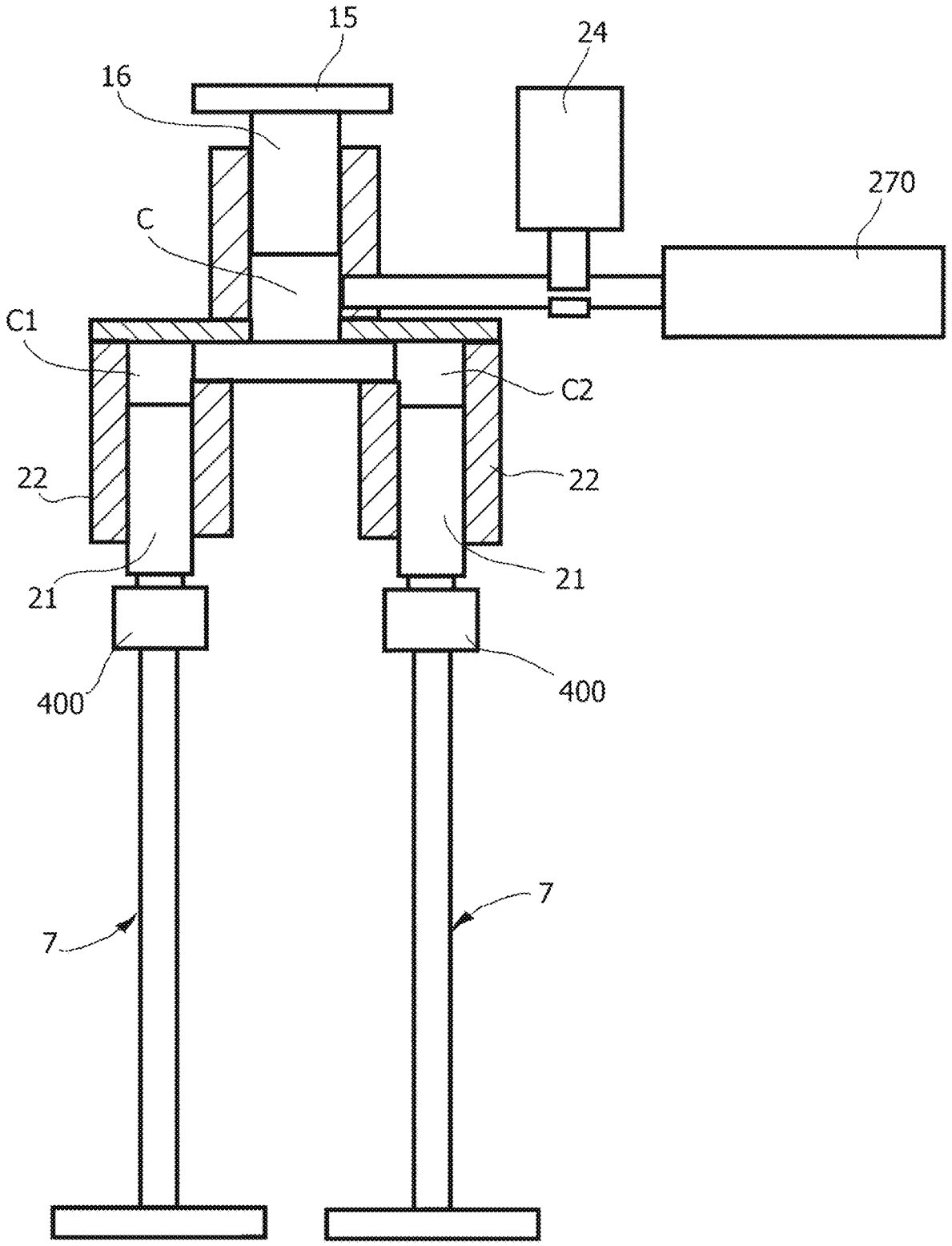
Figure 7:
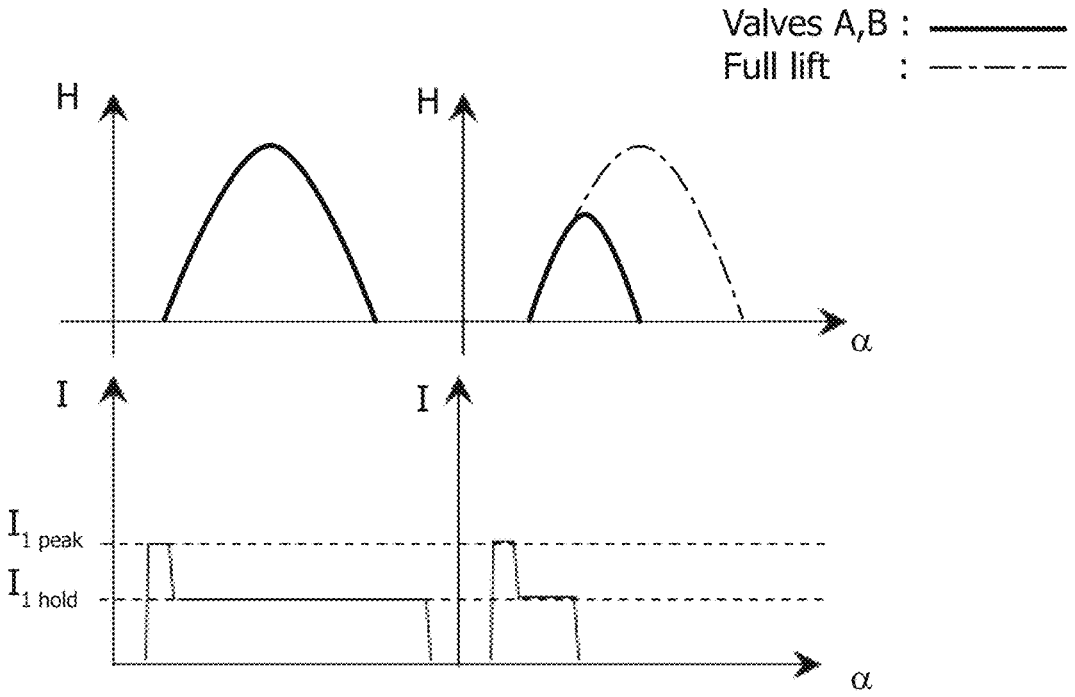
Figure 8:
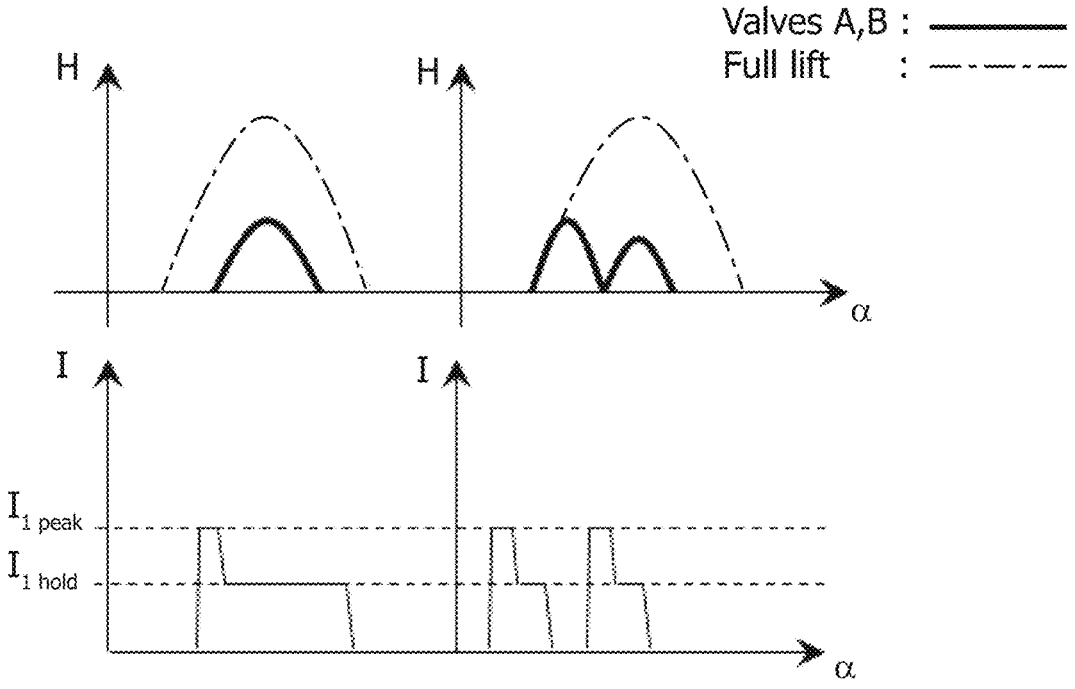
Figure 9:
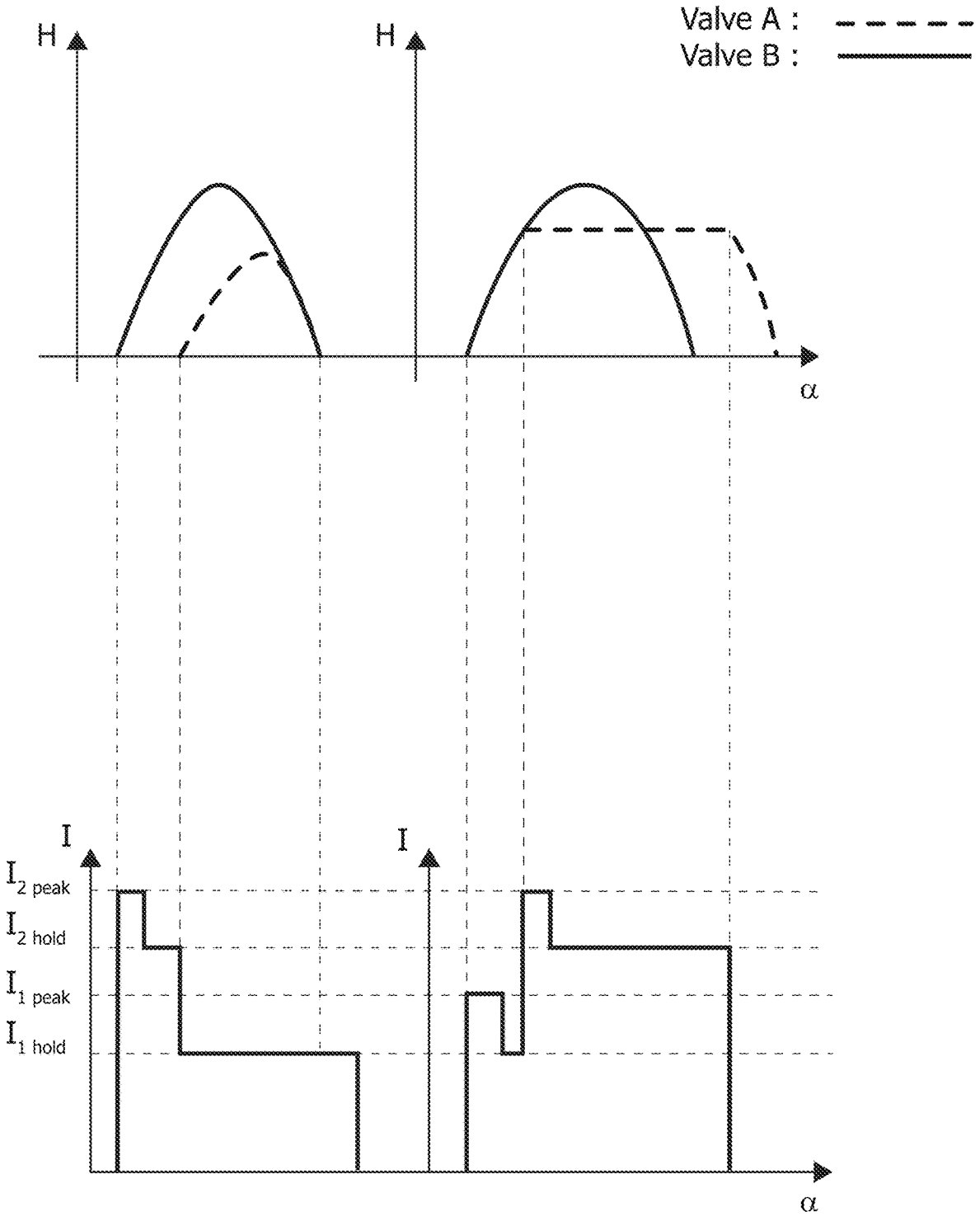
Figure 10:
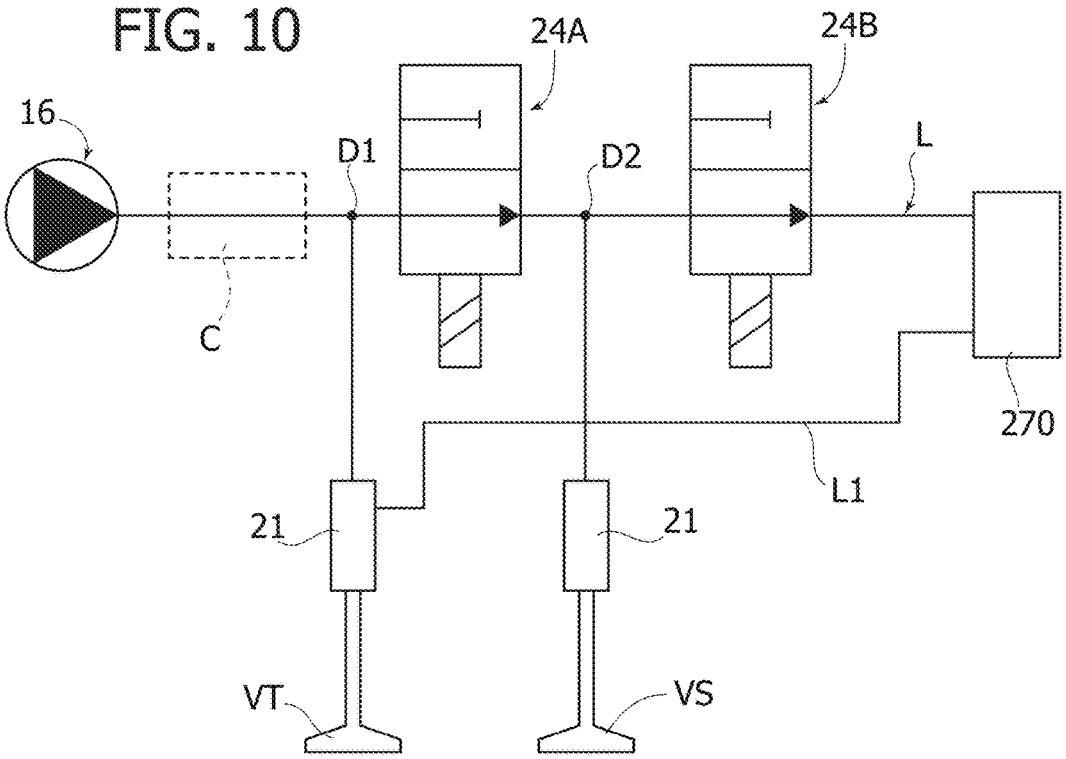
Figure 11:
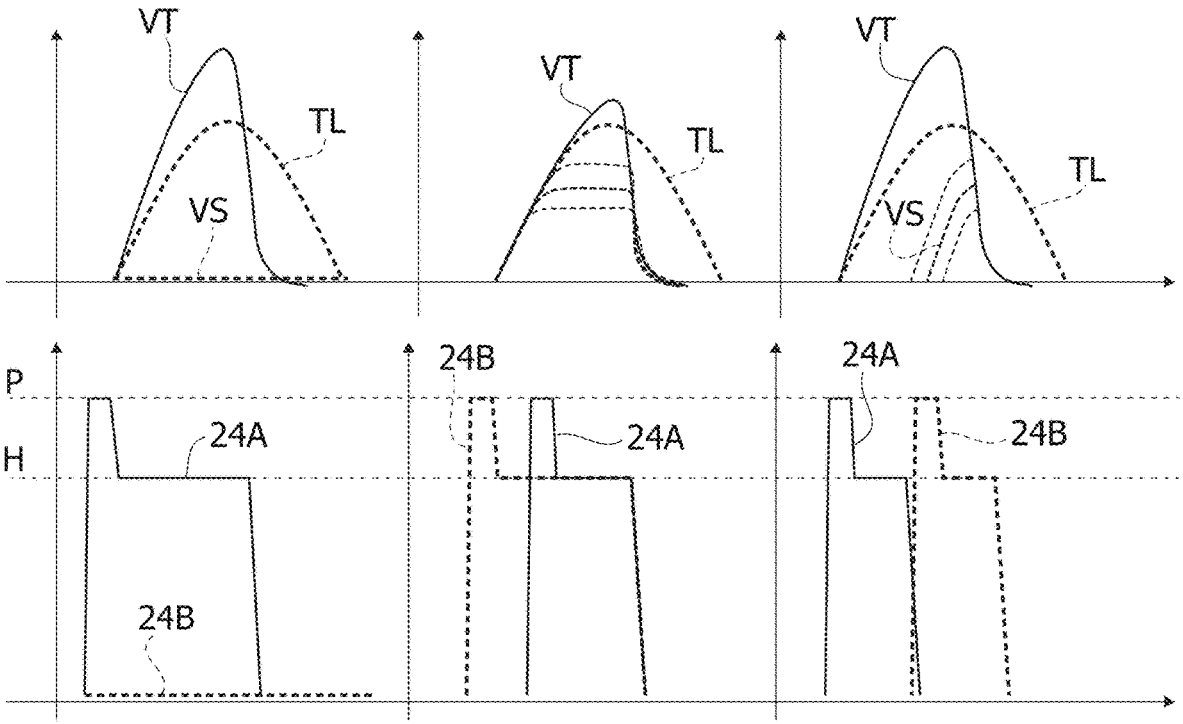

Further features and advantages of the invention will become apparent from the description which follows with reference to the annexed drawings, given purely by way of non limiting example, in which:

FIG. 1 shows a cross-sectional view of the cylinder head of an internal combustion engine provided with a multi-air (registered trademark) system for variable actuation of the intake valves, according to what is illustrated in document EP 0 803 642 B1, FIGS. 2, 3 show the control system for two intake valves associated to a same cylinder of the engine, in a multi-air system of the conventional type described for example in EP 2 261 471 A1, FIGS. 4-6 show a diagram of the control system for the two intake valves, in the embodiment which makes use of a single 3-way 3-position control valve, according to what is described in document EP 2 801 706 A1 of the same Applicant, FIGS. 7-9 are diagrams which show standard modes of operation of the two intake valves which can be obtained with the activation system of FIGS. 4-6, FIG. 10 shows a new embodiment for an electro-hydraulic actuation system for the intake valves of the engine, and FIG. 11 shows diagrams which illustrate different modes of operation of the intake valves which can be obtained through the actuation system of FIG. 10.

The Multi-Air Technology—Known Solutions

FIG. 1 of the annexed drawings show a cross-sectional view of an engine provided with a "multi-air" system, as described in European patent EP 0 803 642 B1.

With reference to this FIG. 1, the engine shown therein is a multi-cylinder engine, such as a engine with four cylinders in line, comprising a cylinder head 1. The head 1 comprises, for each cylinder, a cavity 2 formed in the base surface 3 of head 1, defining the combustion chamber, in which two intake conduits 4, 5 and two exhaust conduits 6 open. The communication of the two intake conduits 4, 5 with the combustion chamber 2 is controlled by two intake valves 7, of the conventional mushroom-like type, each comprising a stem 8 slideably mounted within the body of head 1.

Each valve 7 is biased towards the closed position by springs 9 interposed between an inner surface of head 1 and an end washer 10 of the valve. The communication of the two exhaust conduits 6 with the combustion chamber is controlled by two valves 70, also conventional type, to which there are associated springs 9 biasing towards the closed position.

The opening of each intake valve 7 is controlled, in the way which will be described in the following, by a camshaft 11 rotatebly mounted around an axis 12 within supports of the head 1, and comprising a plurality of cams 14 for actuating the intake valves 7.

Each cam 14 which controls a intake valve 7 cooperates with a disk 15 of a tappet 16 slideably mounted along an axis 17 which, in the case of the example illustrated in the above-mentioned prior document, is directed substantially at 90° with respect to the axis of valve 7. Disk 15 is biased against cam 14 by a spring associated thereto. The tappet 16 constitutes a pumping piston slideably mounted within a bush 18 carried by a body 19 of a pre-assembled unit 20, incorporating all the electric and hydraulic devices associated to the actuation of the intake valves, according to what is described in detail in the following.

The pumping piston 16 is able to apply a force to the stem 8 of valve 7, so as to cause opening of the latter against the action of the springs 9, by means of fluid under pressure (preferably oil coming from the lubrication circuit of the engine) which is present in a pressure chamber C to which the pumping piston 16 is facing, as well as by means of a piston 21 slideably mounted in a cylindrical body constituted by a bush 22 which is also carried by the body 19 of the sub-unit 20.

Also in the known solution shown in FIG. 1, the chamber of fluid under pressure C associated to each intake valve 7 can be put in communication with a discharge channel 23 through a solenoid valve 24. The solenoid valve 24, which can be of any known type, adapted for the function illustrated herein, is controlled by electronic control means, diagrammatically designated by 25, as a function of signals S representative of parameters of operation of the engine, such as the accelerator position and the engine number of revolutions.

When the solenoid valve 24 is opened, chamber C is in communication with channel 23, so that the fluid under pressure present in chamber C flows in this channel and an uncoupling is obtained of cam 14 and the associated tappet 16 with respect to the intake valve 7, which therefore returns rapidly to its closed position under the action of the return springs 9. By controlling the communication between chamber C and the discharge channel 23 it is therefore possible to vary at will the open time and lift of each intake valve 7.

The discharge channels 23 of the various solenoid valves 24 all communicate with a common longitudinal channel 26 which also communicates with pressure accumulators 27, only one of which is visible in FIG. 1.

All the tappets 16 with the associated bushes 18, pistons 21 with associated bushes 22, solenoid valves 24 and corresponding channels 23, 26 are carried and formed in the above-mentioned body 19 of the pre-assembled unit 20, to advantage of quickness and easiness of assembling of the engine.

The exhaust valves 70 associated to each cylinder are controlled, in the embodiment shown in FIG. 1, in a conventional way, by a respective camshaft 28, through respective tappets 29, even if in principle it is not excluded, in the case of the above-mentioned prior document, an application of the hydraulic actuation system also to the control of the exhaust valves.

Also with reference to FIG. 1, the chamber with variable volume defined inside bush 22 and facing towards piston 21 (which in FIG. 1 is shown in its condition of minimum volume, since piston 21 is in its top end position) communicates with the chamber of fluid under pressure C through an aperture 30 formed in an end wall of bush 22. This aperture 30 is engaged by an end nose 31 of the piston 21 so as to provide a hydraulic breaking of the movement of valve 7 in the closing phase, when the valve is approximate to the closed position, since the oil present in the chamber with variable volume is caused to flow into the chamber of fluid under pressure C through the play between the end nose 31 and that the wall of aperture 30 which is engaged the by the nose. In addition to the communication constituted by aperture 30, the chamber of fluid under pressure C and the chamber with variable volume of piston 21 communicate with each other through inner passages formed in the body of piston 21 and controlled by a one-way valve 32 which enables a flow of fluid only from the pressure chamber C towards the chamber with variable volume of piston 21.

During normal operation of the known engine shown in FIG. 1, when the solenoid valve 24 is closed and excludes a communication of the chamber of fluid under pressure C with the discharge channel 23, the oil present in this chamber transmits the movement of the pumping piston 18, imparted by cam 14, to piston 21 which controls the opening of valve 7. In the starting stage of the opening movement of the valve, the fluid coming from chamber C reaches the chamber with variable volume of piston 21 flowing through the one-way valve 32 and further passages which communicate the inner cavity of piston 21, which has a tubular shape, to the chamber with variable volume. After a first displacement of piston 21, nose 31 comes out from aperture 30, so that the fluid coming from chamber C may flow directly into the chamber with variable volume through the aperture 30, which is now free.

In the reverse movements of closing of the valve, as indicated, during the final stage the nose 31 enters into aperture 30 causing an hydraulic breaking of the valve, so as to avoid collisions of the body of the valve against its seat, for example following an opening of the solenoid valve 24 which causes immediate return of valve 7 to the closed position.

In the described system, when the solenoid valve 24 is activated (i.e. when it is closed), the engine valve follows the movement of the cam (full lift). An early closing of the valve can be used by deactivating (i.e. by opening) the solenoid valve 24, so as to empty the hydraulic chamber and obtain closing of the engine valve under the action of the respective return springs. Similarly, a delayed opening of a valve can be used by a delayed activation of the solenoid valve (i.e. by delayed closing thereof) while the combination of a delayed opening and an early closing of the valve can be used with activation and a deactivation of the solenoid valve during the pushing action of the associated cam. According to an alternative strategy, corresponding to the teaching of patent application EP 1 726 790 A1 of the same Applicant, each intake valve can be controlled in a "multi-lift" mode, i.e. with two or more repeated opening and closing "sub-cycles".

In each sub-cycle, the intake valve is opened and then closed completely. The electronic control unit is therefore able to obtain a variation of the opening time and/or closing time and/or lift of the intake valve, as a function of one or more operational parameters of the engine. In this manner, a maximum efficiency of the engine can be obtained, with the minimum fuel consumption, at any operation condition.

FIG. 2 of the annexed drawings corresponds to FIG. 6 of EP 1 674 673 and shows the diagram of the actuation system for the two intake valves associated to each cylinder, in a conventional multi-air system. This figure shows two intake valves 7 associated to a same cylinder of an internal combustion engine, which are controlled by a single pumping piston 16 which on its turn is driven by a single cam of the camshaft of the engine (not shown) which acts against its disk 15. This figure does not show the return springs 9 (see FIG. 1) which are associated to valves 7 and tend to bring them to their respective closed positions.

As shown, in the conventional system of FIG. 2, a single pumping piston 16 controls the two valves 7 through a single pressure chamber C, whose communication with the discharge is controlled by a single solenoid valve 24 and which is hydraulically in communication with both the variable volume chambers C1, C2 towards which the pistons 21 for controlling the two valves are facing.

This solution has clear advantages in terms of a lower bulk within the cylinder head, and reduced cost and lower complexity of the system, whit respect to a solution which has one cam and one solenoid valve for each intake valve of each cylinder.

The system of FIG. 2 is able to operate efficiently and reliably particularly in the case in which the volumes of the hydraulic chambers are relatively small. This possibility is offered by adopting hydraulic tappets 400 outside of the bushes 22, according to what has been illustrated in detail for example in document EP 1 674 673 B1 of the applicant. In this manner, the bushes 22 can have a minor diameter which can be selected as small as desired.

FIG. 3 of the annexed drawings is a diagrammatic illustration of the system shown in FIG. 2, in which it becomes clear that both of the intake valves 7 associated to each cylinder of the engine have their actuators 21 permanent in communication with the pressure chamber C, which on its turn can be either insulated or connected with respect to the discharge channel 23 through the single solenoid valve 24.

The solution shown in FIGS. 2, 3 provides clear advantages in terms of simplicity and reduced cost of manufacture, and also in terms of reduction of dimensions, with respect to the solution shown for example in document EP 0 803 642 B1, which has two solenoid valves for controlling the two intake valves of each cylinder separately.

On the other end, the solution with a single solenoid valve for each cylinder eliminates the possibility of differentiating the control of the intake valves of each cylinder. This differentiation is instead desired: in the case of the diesel engines in which each cylinder is provided with two intake valves associated to respective intake conduits having different shapes, for the purpose of generating different movements of the airflow introduced into the cylinder (see for example FIG. 5 of EP 1 508 676 B1). Typically in these engines the two intake conduits of each cylinder are configured for optimising a "tumbled-like flow and a swirl-like flow inside the cylinder", respectively, these movements being very important for a best distribution of the air charge inside the cylinder, from which the possibility of reducing polluting emissions at the exhaust is substantially dependent.

In spark-ignition engines, this differentiation is desired at low loads of the engine, both for optimising the air flux coefficients through the intake valves and for reducing the pumping cycle accordingly and also for optimising the field of motion of the air inside the cylinder during the intake stage and for improving the homogeneity of the air/fuel mixture.

As indicated, in the multi-year systems with a single solenoid valve for each cylinder, there is no possibility to control the two intake valves of each cylinder independently. It would be desirable instead two increase each time the fraction of the air charge which is introduced with a tumble motion and the refraction of the air charge which is introduced with a swear motion, depending upon the operative conditions of the engine (number of revolutions, load, cold start, etc.).

Similarly, in a spark-ignition engine, particularly when the engine is operating at partial loads or at idle, the problem is posed of introducing a small air charge with sufficient kinetic energy for favouring an optimal field of motion for the combustion inside the cylinder. In these operating conditions, it would be therefore preferable that the entire air masses is introduced by only one of the two intake valves for reducing the dissipation losses in the passage through the valve itself. In other words, for a given mass of air which must be introduced into the combustion chamber and for a given pressure within the intake manifold and for a given vacuum generated by the movement of the piston within the combustion chamber, there are lower dissipation losses (and then hire kinetic energy) for the mass of air introduced by a single intake valve which opens with a lift of 2 h with respect to the case in which the same mass of air is introduced by two intake valves each having a lift of h. If the 2 h lift becomes higher than the threshold determined by the configuration of the cylinder head, it is possible to provide a discharge port in the hydraulic circuit which controls said valve, said discharged port being communicated to a low-pressure environment, not shown in the drawing, which, ones the valve lift has reached a predetermined value, maintains this lift constant up to when this discharge port is closed.

In document EP 2 801 706 A1 of the same applicant there is shown an internal combustion engine of the type indicated at the beginning of the present invention and further characterized in that the solenoid valve associated to each cylinder is a three-way three-position the solenoid valve comprising an inlet which is permanently communicating with said chamber of fluid under pressure and with the actuator of the first intake valve, and the two outlets respectably communicating with the actuator of the second intake valve and would said discharge channel. In this solution, the solenoid valve has the following three operative positions:

- a first position, in which the inlet communicates with both of the outlets, so that the actuators of both the intake valves are put to discharge, and the intake valves are both held closed by their returns springs,
- a second position, in which the inlet communicates only with the outlet connected to the actuator of the second intake valve and does not communicate instead with the outlet connected to the discharge channel, so that the pressure chamber is insulated with respect to the discharge channel, the actuators of both the intake valves communicate with the pressure chamber and the intake valves are therefore both active, and
- a third position, in which the inlet does not communicate with any of the two outlets, so that said pressure chamber is insulated with respect to the discharge channel and said first intake valve is active, whereas the second intake valve is insulated with respect to the pressure chamber.

The control valve associated to each cylinder of the engine can have a solenoid-operated electric actuator or any other type of electric or electromagnetic actuator.

With reference to the diagrammatic illustrations of FIGS. 4-6, the two intake valves associated to each cylinder of the engine (which are designated by references 7A, 7B in FIGS. 4-6) are not both permanently connected to the chamber of fluid under pressure C. In the case of this solution, only one of the two intake valves (the valve which in the drawings is designated by reference 7B) has its hydraulic actuator 21 permanently communicating to the chamber of fluid under pressure C. Furthermore, the two-position two-way solenoid valve 24 is replaced by a three-way three-position solenoid valve, having an inlet "i" which permanently communicates to the chamber of fluid under pressure C, and to the hydraulic actuator of the intake valves 7B, and two outlets u1, u2. Outlet u1 is permanently communicating with the hydraulic actuator 21 of the intake valve 7A, whereas the outlet u2 is permanently connected to the discharge channel 23 and the hydraulic accumulator 270.

FIG. 4 shows the solenoid valve in its first operative position P1, corresponding to a de-energized condition of its solenoid. In this position, inlet i is in communication with both outlets u1, u2, so that the hydraulic actuators of both intake valves 7A, 7B, as well the chamber of fluid under pressure C are in communication with the discharge channel 23 and the accumulator 270, so that both the valves are uncoupled with respect to the tappet and held closed by the respective return springs.

FIG. 5 shows a second position of the solenoid valve, corresponding to a first energization level of the solenoid, in which inlet i is in communication with outlet u1, whereas the communication between inlet u and outlet u2 is interrupted. Therefore, in this condition the actuators of both the intake valves 7A, 7B are in communication with the pressure chamber C and the latter is insulated with respect to the discharge channel 23, so that both the intake valves are active and sensitive to the movement of the respective tappet.

FIG. 6 shows the third operative position of the solenoid valve, corresponding to a second energization level, higher than the first energization level, in which the inlet i is insulated with respect to both outlets u1, u2 so that the chamber of fluid under pressure C is insulated with respect to the discharge channel 23 and the intake valve 7B is therefore active and sensitive to the movement of the respective tappet, whereas in this condition the actuator of the intake valve 7A is insulated both with respect to the chamber of fluid under pressure (so that it is uncoupled with respect to the movements of the respective tappet) and with respect to the discharge channel 23.

Therefore, as shown, it is possible to render the two intake valves 7A, 7B associated to each cylinder of the engine both sensitive to the movement of the respective tappet, but it is also possible to uncouple both of them from the respective tappet by causing them to be held closed by the respective return springs, and it is also possible to uncouple only the intake valve 7A from the respective tappet, while leaving only intake valve 7B active.

When an opening command for the two intake valves 7A, 7B ceases, the solenoid valve is brought again to position P1 to enable the pumping piston 16 to draw a flow of oil from volume 270 towards volume C.

FIGS. 7, 8 of the annexed drawings show lift diagrams of the intake valves and the corresponding diagrams of the current supplying the solenoid of the solenoid valve, when the solenoid valve is used by shifting it only between position P1 and position P2, that is between the conditions respectably shown in FIG. 4 and FIG. 5. In the case of an operation of this type, the two intake valves associated to each cylinder of the engine are driven in ways identical to each other, that is similarly to what takes place in a conventional system with solenoid valves having only two positions, as illustrated in FIG. 3.

The diagram at top left of FIG. 7 shows a "full lift" mode in which both the intake valves of each cylinder of the engine are controlled in a conventional way by causing each of them to take the full-lift which is driven by the respective cam over the engine camshaft. The diagram shows lift H of both valves as a function of the engine crank angle $\alpha$. The portion at bottom left of FIG. 7 shows a diagram of the current supplying the solenoid of the solenoid valve in the above mentioned full-lift mode. In order to enable opening of both the intake valves associated to each engine cylinder during the active stage of the respective tappet, in which the tappet tends to open the valves, the solenoid valve is brought from position P1 to position P2 (condition shown in FIG. 5), in which both of the valves 7A, 7B are coupled with the tappet. This is obtained by supplying the solenoid with a first current level I. It is to be observed that the portion at bottom left of FIG. 7 shows, by way of example, a current diagram in which, according to a technique known per se, the solenoid of the solenoid valve is supplied initially with a peak current I1 peak and right thereafter with a hold current I1 hold throughout the entire field of rotation of the crankshaft in which the tappet tends to open the intake valves. However, it is possible to provide for a constant current level for each of positions P2 and P3 of the solenoid valve.

The portion at top right of FIG. 7 shows an "early closing" mode of conventional type, in which both the intake valves associated to each cylinder of the engine are closed simultaneously in advance with respect to the end of the active phase of the respective tappet, so that the lift diagram of both valves is that shown by undotted line that in the portion at top right of FIG. 7, rather than that illustrated by dotted line (which is coincident with the previously discussed full-lift case). The portion at bottom right of FIG. 7 shows the corresponding diagram of the current for supplying the solenoid. As shown, in this case the solenoid valve is brought to the position P2 as in the "full-lift" case, but then the current supplying the solenoid is brought to zero in advance with respect to the end of the active phase of the tappet, so that the solenoid valve returns to position P1 and both the intake valves associated to each cylinder return to their closed condition in advance with respect to the end of the active phase of the respective tappet.

FIG. 8 of the annexed drawings shows two other modes of operation of known type, in which both the intake valves associated to each cylinder are controlled so that the variation of movements of each valve is identical to the other by shifting the solenoid valve which controls the intake valves only between positions P1 and P2: therefore, by undotted line there is shown the movement of both valves. The portion at top left of FIG. 8 shows the lift of both the intake valves (undotted diagram) in a "late opening" mode in which the solenoid of the solenoid valve is supplied with a current at level I1 starting from an instant of time subsequent to the beginning of the active phase of the tappet. Therefore, each of the two intake valves does not have a full-lift (shown by dotted line in the section at top left of FIG. 8) but rather a reduced lift (shown by undotted line). Since in this case the intake valves of each cylinder are coupled to the respective cam after a given time from the beginning of the active phase of the tappet, the two valves open with a reduced lift, since they will feel only the remaining portion of the profile of the respective actuating cam, which brings the consequence of that the valves return to their closed positions in advance with respect to the full-lift case.

More in detail, the cam is characterised by a profile 14 such that it moves piston 17 of the pumping cylinder 16 rigidly connected their two according to $h=h(\theta)$ law where h is the axial displacement of piston 17 and $\theta$ is the angular rotation of the shaft on which cam 11 is connected. Depending on the angular speed of the cam, therefore, the piston is moved to according to a $h=(\theta, t)$ law.

Independently from the angular speed of the cam, at each revolution of the camshaft the piston 17 will always move at the same volume of oil V st max=H max*area st, where H max is the maximum travel of the piston imparted by the profile of the cam (all losses are herein neglected which depend from losses in feeling the piston chamber, leakages, or non-perfect coupling between cam and piston, the oil being supposed the to be incompressible). The maximum displacements of the intake valves depends from the volume of oil which is pumped inside element 21: the case of full lift of both the intake valves corresponds to the case in which the entire volume V st max is used to move the above mentioned valves, which therefore reach their maximum lift S max. If solenoid valve 24 is shifted when the piston is moving, so as to put a certain volume of oil to discharge, the travel S of the intake valves will be lower than S max and the difference S max-S will be proportional to the volume which is passed through solenoid valve 24. Therefore it is understood why, in the diagram at the left of FIG. 8, the profile of the intake valves does not reach the maximum lift S max.

Also in the case of FIG. 8, the current diagrams relate to an example in which the current level I1 is provided by at first reaching a peak level I1 peak and then bringing the current to a lower level I1 hold. However, it is clearly apparent that also in this case simplified current profiles may be adopted, without a starting peak level.

The portion at top right of FIG. 8 shows the lift diagram of both the intake valves associated to each cylinder of the engine in a "multi-lift" mode in which both intake valves do not have the full lift profile shown with dotted line, but instead they are opened and closed completely more than one time during the active phase of the respective tappet (undotted line diagram). This mode of operation is obtained with the current profile shown in the section at bottom right of FIG. 8, where it is shown that the solenoid of the solenoid valve is supplied at current level I1 (in the case of the illustrated example through a first peak value I1 peak and then with a lower hold value I1 hold) and then is again completely de-energized, to be again energized at level I1 and then again de-energized, both the above indicated cycles being carried out within the field of rotation of the engine crankshaft corresponding to the active phase of the tappet which controls the intake valves. In this manner, the solenoid valve is brought initially to position P2, so that both the valves start to open, but then is brought again to position P1, so as to close completely both valves. A new energization of the solenoid at level I1 causes a new displacement of the solenoid valve to position P2 and then a new opening of both valves, which then are closed again definitely as soon as the solenoid is de-energised for the second time. In this manner, within the active phase of tappet which controls the intake valves, both intake valves are opened and closed completely two or more times.

The modes of operation shown in FIGS. 7, 8 which have been described in the foregoing are conventional modes of operation in Multi-air (registered trademark) systems, since in this case three positions' solenoid valves is used as a solenoid valve with two only positions, similarly to conventional Multi-air systems.

The diagrams of FIG. 9 of the annexed drawings show additional modes of operation of the engine which have been already illustrated in EP 2 801 706 A1. In this additional control modes, the two intake valves associated to each cylinder of the engine are controlled in a differentiated manner. In the above mentioned diagrams and in the descriptions which follows, the lift diagrams of the intake valves 7A, 7B, previously discussed with reference to FIGS. 4,6 are designated simply as "valve A" and "valve B" respectively and are therefore differentiated.

In the top portion of FIG. 9, the undotted line diagrams show lift profiles of the valve B, whereas the dotted line diagrams show lift profiles of valve A respectively in two different modes of operation.

The left section of FIG. 9 shows a mode of operation in which valve B is controlled in a full lift mode, i.e. so as to cause it to have a conventional lift cycle during the active phase of the respective tappet. Differently from valve B, valve A is controlled in a "delayed opening" mode in which valve A is opened with a delay with respect to valve B. This mode of operation is obtained by supplying the solenoid of the solenoid valve according to the current profile shown in the left section of the low portion of FIG. 9. As shown, the solenoid is supplied initially at a current level I2 so as to bring the solenoid valve from position P1 to position P3 (condition shown in FIG. 6). The example shown relates to the case in which the current level I2 is obtained by adopting at first briefly a peak level I2 peak and then lowering the current to a hold level I2 hold. As indicated many times above, it will be also possible to provide simplified current diagrams, with a constant current level for which of positions P2 and P3. This possibility applies also to all the other modes of operation described herein.

Also with reference to the top left portion of FIG. 9, with regard to the mode of operation of the solenoid valve 24, it is understood that the shift from position P1 to position P3 takes place by passing for a very small time through position P2: however, from the point of view of the intake valves, this transition is not appreciated and therefore they see the solenoid valve 24 to shift directly from position P1 to position P3.

Also with reference to the left section of the lower part of FIG. 9, during the active phase of the tappet, the supplied current of the solenoid is lowered at a level P1 hold which is held throughout the remaining part of the active phase of a tappet. When the level of the supplied current passes from I2 to I1, the solenoid valve moves from position P3 shown in FIG. 6 to position P2 shown in FIG. 5. Therefore, in the case of the mode of operation shown in the left part of FIG. 9, the solenoid valve is initially brought to position P3 (FIG. 6) so that only valve B is coupled to the respective tappet and only valve B is opened according to the conventional lift profile. In the first part of the active phase of the tappet, therefore, valve A remains closed. In that time instant in which the current supplying the solenoid of the solenoid valve is brought from level I2 to level I1, the solenoid valve shifts from position P3 shown in FIG. 6 to position P2 shown in FIG. 5 so as to couple both valves A, B to the respective tappet. Therefore, starting from this instant of time, also valve A is opened. As a result of this, in this case the opening of valve A takes place with a delay with respect to the opening of valve B. The valve A feels the respective tappet throughout the remaining part of the active phase of the tappet, so that it has a lift diagram corresponding to the dotted line in the left section of the top portion of FIG. 9 and is closed together with valve B.

The right section of the top portion of FIG. 9 shows a further control mode for the intake valves. Also in this case, valve B has a conventional lift cycle, since it is coupled to the respective tappet throughout the entire duration of the active phase of the tappet. Instead valve A has a lift profile shown by dotted line in the right section of the top portion of FIG. 9. This mode of operation is obtained by supplying the solenoid of the control valve according to a current profile which is shown in the right section of the bottom portion of FIG. 9. As shown, at the start of the active phase of the tappet, the solenoid of the control valve is supplied with a current level I1 (which as usual in the case of the illustrated example has a starting peak level and a subsequent maintenance level). During the active phase of the tappet, the supply current is then brought to the higher level I2 (again, in this specific example, a first peak level and then a maintenance level are provided). Also with reference to the right section of FIG. 9, the supply current of the solenoid is then brought to zero at a time subsequent to the end of the active phase of the tappet. As shown, in the case of this control mode, the valve B is controlled in a "full lift" mode, whereas valve A is controlled in a "delayed closing" mode. At the start of the active phase of the tappet, the solenoid valve is supplied at level I1 and therefore is in the position P2 shown in FIG. 2. In this condition, both the intake valves A and B are opened, as shown in diagrams in the right section of FIG. 9. Subsequently, during the active phase of the tappet, the supply current of the solenoid is brought to level I2, so that the solenoid valve shifts to position P3, shown in FIG. 6, in which valve B remains coupled to the tappet, whereas valve A is insulated. In this condition, therefore, valve A remains in the opened position in which it is located at the moment when the solenoid valve is brought to position P3. As shown in the right section of FIG. 9, the current level I2 is maintained also after the end of the active phase of the tappet, so that, in this control mode, valve A remains locked in said opened position also after the end of the active phase of the tappet. Valve A returns to the closed condition only when the supply current of the solenoid of the control valve is brought again to zero, so that the solenoid valve returns to position P1.

Therefore, in the mode of operation described in the right sections of FIG. 9, one of the two intake valves is controlled in a conventional way, whereas the other intake valve is partially opened and then maintained in this partially opened position also after the end of the active phase of the respective tappet. The duration of the phase in which the intake valve A is locked in said partially opened position can be determined at will, since it is a function of the selected current profile. If desired, due to the above-mentioned measure, valve A can remain locked in the partially opened position through any range of rotation of the crankshaft for each revolution of the crankshaft, if necessary also through 360° (naturally by selecting a lift level such that valve A does not come in contact with the piston when the latter is at its top position in the cylinder, or by adopting for the piston geometry a geometrical configuration which avoids this contact; furthermore, the movement of valve A when the solenoid valve 24 is at position P3 is affected by leakages of the solenoid valve 24 itself).

The Invention

FIG. 10 shows a diagram of a system for variable actuation of the intake valves according to the present invention, which can be used for actuating two intake valves VT, VS of a same cylinder of the engine. In one preferred example, the two intake valves are associated to an intake conduit configured to generate a tumble motion of the air flow introduced into the cylinder and an intake conduit configured to generate a swirl motion of the air flow introduced into the cylinder, in accordance to what is disclosed in a copending patent application of the same Applicant.

The system shown herein comprises, similarly to the known systems which have been described in the foregoing, a single pumping cylinder 16 actuated by a respective cam of the camshaft of the engine, for controlling the operation of the two intake valves of each cylinder. In this case, the communication of the hydraulic actuators 21 and the two intake valves VT, VS with the discharge channel 270 is controlled by means of two electrically actuated control valves 24A, 24B, both of an on/off two position type, arranged in series with each other along a hydraulic line L which communicates the pressure chamber C to the discharged environment 270.

The control valves 24A, 24B can be two solenoid valves of any known type, for example two normally opened solenoid valves which are shifted to a closed position by energizing a respective solenoid.

Also with reference to FIG. 10, the hydraulic line L includes, starting from pressure chamber C towards the discharge channel 270, a first branch-off point D1, connected to the hydraulic actuator 21 of the intake valve VT, associated to the intake conduit which is configured for generating a tumble motion, and a second branch-off point D2 connected to the hydraulic actuator 21 of the intake valve VS associated to the intake conduit configured for generating a swirl motion.

A first solenoid valve 24B is arranged between the second branch-off point D2 and the discharge channel 270, so that when the solenoid valve 24B is closed, the communication is interrupted of the discharged environment 270 with both the hydraulic actuators 21.

The second solenoid valve 24A is arranged along line L between the branch-off points D1 and D2. Therefore, when the solenoid valve 24A is closed, the actuator 21 of the intake valve VT is always in communication with the pressure chamber C, whereas the communication between actuator 21 of intake valve VT and the discharge channel 270 is anyway interrupted, independently from the condition of operation of solenoid valve 24B. At the same time, when the solenoid valve 24A is closed, the actuator 21 of intake valve VS is no longer in communication with the pressure chamber C, independently from the condition of operation of solenoid valve 24B.

FIG. 11 shows three different diagrams corresponding to three different modes of operation which can be activated whit the use of the actuation system of FIG. 10, depending upon the conditions of operation of the engine. The lower part of FIG. 11 shows the corresponding current profiles for supplying the two solenoid valves 24A, 24B.

In FIG. 11, in addition to the lift diagrams of the intake valves VT and VS there is also shown the standard lift diagram TL, corresponding to the profile of the cam: the standard lift diagram corresponds to the configuration of valve 24A opened and valve 24B closed during the time interval in which the pumping piston drive by the cam profile compresses the oil in chamber C. In phases in which only the intake valve VT is actuated all the fluid under pressure displaced by the pumping piston is transferred only to the actuator 21 of the intake valve VT (neglecting any oil leakages). Therefore in this condition the intake valve VT would tend to have a maximum lift corresponding to the double of the maximum lift and a double lift profile (with faster lift of the intake valve VT) with respect to a standard cycle in which the fluid displaced by the pumping piston is used for opening both the intake valves. This effect is not desired, so that according to the invention it is provided that the actuator 21 of the intake valve VT has not able in any case to move the valve beyond a predetermined threshold lift position. For this purpose, with reference to FIG. 10, the hydraulic actuator 21 of the intake valve VT associated to the intake conduit which is configured for generating a tumble motion is preferably provided with a discharge outlet which through a line L1 puts the chamber under pressure of actuator 21 to discharge when the movable member of the actuator is displaced through a length greater than a predetermined value. In this manner, it is prevented that the first intake valve VT has a lift greater than a maximum predetermined limit, depending upon constructional limitations associated to the configuration of the cylinder head of the engine.

The mode of operation shown in the left part of FIG. 11 is activated in the conditions of reduced operation of the engine, below a determined load of the engine and/or below a determined speed of revolution of the engine. In this condition, the solenoid valve 24B is maintained always opened, whereas the solenoid valve 24A is closed during the actuating cycle of the pumping piston 16 by the cam, so that the actuator 21 of the intake valve VT is sensitive to the movement of the cam, whereas the intake valve VS, since it is isolated with respect to the pressure chamber C, remains always stationary in its closed position, also if it does not communicate with the discharge channel 270. In particular, in the case of particularly reduced engine loads and a relatively large combustion chambers, it might be preferable to open even only partially the valve VT.

In an intermediate condition of operation of the engine, the mode of operation shown in the central part of FIG. 11, of the mode of operation shown in the right part of FIG. 11, can be activated.

With reference to the mode shown in the central part of FIG. 11, in this case, at the beginning of the lift cycle of the cam, only the solenoid valve 24B is closed, so as to interrupt the communication of both the actuators 21 with the discharge channel, whereas the two actuators are in communication with the pressure chamber C. Therefore, both the intake valves VT, VS start their normal lift cycle. In an intermediate phase of the actuating cycle of the pumping piston 16 by the cam, the solenoid valve 24A is closed so as to interrupt the communication between the branch-off point D1 and the branch-off point D2. As a result of this, the intake valve VT continues its lift cycle, but with a greater speed, thus reaching the lift which is permitted by the remaining oil introduced into chamber C by the pumping piston 16 during the remaining part of its compression stroke, whereas the intake valve VS has its actuator isolated both with respect to the pressure chamber C and with respect to the discharge channel and therefore it remains in a stationary position corresponding to the reached partial opening position (in FIG. 11 by dotted line there are shown different degrees of lift of valve VS which can be obtained by varying the closing time of solenoid valve 24, of which however only one actuating profile is shown. At the end of the lift cycle of the cam, both the solenoid valves 24A, 24B are opened thus establishing again the communication of both of the actuators 21 with the discharge channel 270, so as to enable a normal complete closing of both the intake valves.

The mode of operation shown in the right part of FIG. 11 is a mode of operation in which the intake valve VT performs a lift cycle in which a first section is characterized by a higher (about the double) opening speed with respect to a conventional case, thus reaching a maximum lift which is greater with respect to the conventional profile TL, provided that the limiting device L1 does not earlier come into action, whereas the intake valve VS is opened with a delay, so that it performs a partial lift cycle after which it is closed simultaneously with the closing of the intake valve VT.

This third mode of operation is obtained by closing only the solenoid valve 24A at the beginning of the cam lift cycle, and then opening the same valve 24A and closing the solenoid valve 24B in an intermediate phase of the cam lift cycle, so as to isolate the actuator 21 of the valve VS from the discharge environment and put it in communication with the chamber C. Both the solenoid valves are opened again at the final stage of the lift cycle of the cam, so as to enable closing of both the intake valves.

Naturally, while the principle of the invention remains the same, the embodiments and the details of construction may widely vary with respect to what has been described and shown purely by way of example, without departing from the scope of the present invention, as defined in the annexed claims.

What is claimed is:

1. Internal combustion engine, comprising, for each cylinder:

a combustion chamber, a first intake conduit and a second intake conduit and at least one exhaust conduit opening on said combustion chamber, a first intake valve and a second intake valve respectively associated to said first intake conduit and said second intake conduit and at least one exhaust valve associated to said at least one exhaust conduit, said intake and exhaust valves being provided with respective return springs which bias the intake and exhaust valves towards a closed position, a camshaft for actuating the intake valves, by respective tappets, wherein each intake valve of the first intake valve and the second intake valve is driven by a respective tappet against the action of said return spring with the interposition of a hydraulic circuit including a volume of fluid under pressure towards which a pumping piston is facing which is associated to the valve tappet, said volume of fluid under pressure being adapted to communicate with the chamber of a hydraulic actuator associated to said intake valve, each intake valve of the first intake valve and the second intake valve being associated to at least one electrically-actuated control valve adapted to communicate, when it is opened, said volume of fluid under pressure to a low pressure discharge channel, for the purpose of uncoupling said intake valve from the respective tappet and causing a quick closing of said intake valve due to the action of the respective return spring, at least one electronic controller for controlling said at least one control valve for varying the opening and/or closing time and the lift of each intake valve of the first intake valve and the second intake valve as a function of one or more operative parameters of the engine, the first intake valve and the second intake valve of each cylinder are controlled by a single cam of said camshaft through a single hydraulic circuit and the communication of the hydraulic actuators of the two intake valves with said discharge channel is controlled by two electrically-actuated control valves of said at least one control valve, both of an on/off two-position type, arranged in series with each other along a hydraulic line for communication between the pressure volume and the discharge channel, wherein said communication hydraulic line includes, starting from said pressure volume towards said discharge channel:

a first branch-off point connected to the hydraulic actuator of the first intake valve, a second branch-off point connected to the hydraulic actuator of the second intake valve, wherein a first valve of said two control valves is arranged between said second branch-off point and the discharge channel so that when said first control valve is closed, a communication with the discharge channel is interrupted for both the hydraulic actuators, and wherein a second control valve of said two control valves is arranged in said communication line between said two branch-off points, so that when said second control valve is closed:

the actuator of the first intake valve is always in communication with the pressure volume, whereas a communication with the discharge channel is interrupted, independently from the condition of operation of the first control valve, and the actuator of the second intake valve is no longer in communication with the pressure volume, independently from the condition of operation of the first intake valve.

2. Engine according to claim 1, wherein:

said electronic controller is configured and programmed for controlling said control valves so as to partially or totally open only the first intake valve of each cylinder in a reduced condition of operation of the engine, below a predetermined load of the engine and/or below a predetermined speed of revolution of the engine, and so as to partially or totally open both the intake valves in the remaining operating conditions of the engine.

3. Engine according to claim 2, wherein:

said first intake conduit is configured so that it generates within the cylinder a tumble motion of the airflow introduced into the cylinder through said first intake conduit when the first intake valve associated thereto is at least partially opened, said second intake conduit is configured so that it generates within the cylinder a swirl motion of the airflow introduced into the cylinder through said second intake conduit when the second intake valve is at least partially opened, the intake valve which is the only valve to be, partially or totally, opened in said condition of reduced operation of the engine is said first intake valve (VT) which is associated to said first intake conduit, which is configured for generating a tumble motion.

4. Engine according to claim 2, wherein said electronic controller is configured and programmed for controlling said control valves, so that, at least in a intermediate condition of operation of the engine, above said condition of reduced operation, said second intake valve is controlled according to a partial opening mode, in which the second intake valve performs a lift movement lower than its maximum lift.

5. Engine according to claim 4, wherein said electronic controller is configured and programmed so that in said partial lift mode, said second intake valve remains in a stationary position, corresponding to a predetermined partial lift, during its opening cycle.

6. Engine according to claim 4, wherein said electronic controller is configured and programmed so that in said partial lift mode of the second intake valve the latter is controlled according to a late opening mode, in which the valve is opened with a delay with respect to the start of the lift cycle caused by the profile of the respective actuating cam.

7. Engine according to claim 6, wherein said electronic controller is configured and programmed so that in said late opening mode said second intake valve is again closed together with the first intake valve at the end of the lift cycle caused by the profile of the respective actuating cam.

8. Engine according to claim 4, wherein said electronic controller is configured and programmed so that in said partial lift mode of the second intake valve it is controlled according to a multi-lift mode, in which it is opened partially and closed again completely many times during a same lift cycle of the respective actuation cam.

9. Engine according to claim 4, wherein said electronic controller is configured and programmed so that in said partial lift mode of the second intake valve the valve is controlled according to a delayed closing mode, in which it is opened partially and closed again completely with a delay with respect to the end of a lift cycle of the respective actuating cam.

10. Engine according to claim 1, wherein the hydraulic actuator of said first intake valve is provided with a discharge outlet which prevents said first intake valve from having a lift greater than a predetermined maximum limit when the fluid under pressure displaced by said pumping piston is transferred only to the actuator of said first intake valve.

11. Method for controlling the operation of an internal combustion engine, wherein said engine comprises, for each cylinder:

a combustion chamber, a first intake conduit and a second intake conduit and at least one exhaust conduit opening on said combustion chamber, a first intake valve and a second intake valve, respectively associated to said first intake conduit and said second intake conduit and at least one exhaust valve associated to said at least one exhaust conduit, said intake valves and said exhaust valves being provided with respective return springs which bias the valve towards a closed position, a camshaft for actuating the intake valves by means of respective tappets, wherein each intake valve is driven by a respective tappet against the action of said return spring with the interposition of hydraulic means including a volume of fluid under pressure towards which a pumping piston is facing which is associated to the valve tappet, said volume of fluid under pressure being adapted to communicate with the chamber of a hydraulic actuator associated with said intake valve, each intake valve being associated to at least one electrically-actuated control valve adapted to communicate said volume of fluid under pressure with a discharge channel, for the purpose of uncoupling said intake valve from the respective tappet and causing a quick closing of said intake valve due to the action of the respective return spring, at least one electronic controller is provided for controlling said at least one control valve for varying the opening and/or closing time and the lift of each intake valve as a function of one or more operative parameters of the engine, the two intake valves of each cylinder are controlled by a single cam of said camshaft through a single hydraulic circuit and the communication of the hydraulic actuators of the two intake valves with said discharge channel is controlled by two electrically-actuated control valves, both of an on/off two-position type, arranged in series with each other along a hydraulic line for communication between the pressure volume and the discharge channel, wherein said communication hydraulic line includes, starting from said pressure volume towards said discharge channel:

a first branch-off point connected to the hydraulic actuator of a first intake valve, a second branch-off point connected to the hydraulic actuator of a second intake valve, wherein a first control valve of said control valves is arranged between said second branch-off point and the discharge channel, so that when said first control valve is closed, the communication with the discharge channel is interrupted for both the hydraulic actuators, the second control valve is arranged in said communication line between said two branch-off points, so that when said second control valve is closed:

the actuator of the first intake valve is always in communication with the pressure volume, whereas a communication with the discharge channel is interrupted, independently from the condition of operation of the first control valve, the actuator of the second intake valve is no longer in communication with the pressure volume, independently from the condition of operation of the first intake valve, said electronic controller controls said control valves so as to partially or totally open only the first intake valve of each cylinder in a reduced condition of operation of the engine, below a predetermined load of the engine and/or below a predetermined speed of revolution of the engine, and so as to partially or totally open both the intake valves in the remaining operating conditions of the engine.

12. Method according to claim 11, wherein:

said first intake conduit is configured so as to generate within the cylinder a tumble motion of the airflow introduced into the cylinder through said first intake conduit when the intake valve associated thereto is at least partially opened, said second intake conduit is configured so as to generate within the cylinder a swirl motion of the airflow introduced into the cylinder through said second intake conduit when the second intake valve is at least partially opened, the intake valve which is the only one to be, partially or totally, opened, in said condition of reduced operation of the engine is said first intake valve, associated to said first intake conduit, which is configured for generating a tumble motion.

13. Method according to claim 11, wherein said electronic controller controls said control valves so that at least in one intermediate condition of operation of the engine, above said condition of reduced operation, said second intake valve is controlled according to a partial lift mode, in which it performs a lift movement lower than its maximum lift.

14. Method according to claim 13, wherein in said partial lift mode, said second intake valve remains in a stationary position, corresponding to a predetermined partial lift, during its opening cycle.

15. Method according to claim 13, wherein in said partial lift mode of the second intake valve, it is controlled according to a late opening mode, in which it is opened with a delay with respect to the start of the lift cycle determined by the profile of the respective actuating cam.

16. Method according to claim 15, wherein in said late opening mode, said second intake valve is again closed together with the first intake valve at the end of the lift cycle caused by the profile of the respective actuating cam.

17. Method according to claim 13, wherein in said partial lift mode of the second intake valve, this valve is controlled according to a multi-lift mode, in which it is partially opened and closed again completely many times during a same lift cycle of the respective actuating cam.

18. Method according to claim 13, wherein in said partial lift mode of the second intake valve, it is controlled according to a delayed closing mode, in which it is partially opened and closed again completely with a delay with respect to the end of a lift cycle of the respective actuating cam.

19. Method according to claim 11, wherein in the stages in which only said first intake valve is opened, when the fluid under pressure displaced by said pumping piston is transferred only to the actuator of said first intake valve, said first intake valve is prevented from having a lift greater than a maximum predetermined limit, by communicating this actuator with a discharge line above a predetermined stroke of the first intake valve.

* * * * *